US010166158B2

(12) United States Patent
Trinder, II

(10) Patent No.: US 10,166,158 B2
(45) Date of Patent: Jan. 1, 2019

(54) ANTIMICROBIAL COVERS FOR RAILS

(71) Applicant: EOS Surfaces, LLC, Norfolk, VA (US)

(72) Inventor: Kenneth G Trinder, II, Norfolk, VA (US)

(73) Assignee: EOS SURFACES, LLC, Norfolk, VA (US)

( * ) Notice: Subject to any disclaimer, the term of this patent is extended or adjusted under 35 U.S.C. 154(b) by 463 days.

(21) Appl. No.: 15/138,374

(22) Filed: Apr. 26, 2016

(65) Prior Publication Data

US 2017/0013969 A1 Jan. 19, 2017

Related U.S. Application Data

(60) Provisional application No. 62/231,849, filed on Jul. 17, 2015.

(51) Int. Cl.
*B25G 1/10* (2006.01)
*A61G 7/05* (2006.01)

(52) U.S. Cl.
CPC ..... *A61G 7/0507* (2013.01)

(58) Field of Classification Search
CPC ..... B62B 5/069; Y10T 16/48; Y10T 16/466; Y10T 16/469; Y10T 16/4559
See application file for complete search history.

(56) References Cited

U.S. PATENT DOCUMENTS 4,071,063 A * 1/1978 Russell ..... A45F 5/1046 16/411
4,841,638 A * 6/1989 Bardeen ..... B23D 51/01 30/332
5,115,530 A * 5/1992 Distiso ..... A46B 13/08 15/143.1
5,478,137 A * 12/1995 Olson ..... A47C 7/546 297/227
5,722,672 A * 3/1998 Frederick ..... B62B 5/06 150/154
5,727,258 A * 3/1998 Derouin ..... A47K 13/105 4/246.1
5,920,250 A * 7/1999 Watanabe ..... H05K 9/0066 333/12

(Continued)

FOREIGN PATENT DOCUMENTS

JP 2001123711 A * 5/2001
WO WO-2007114718 A1 * 10/2007 ..... B62B 3/1408

*Primary Examiner* — Chuck Y Mah
(74) *Attorney, Agent, or Firm* — Peter J. Van Bergen

(57) ABSTRACT

A rail cover assembly includes first and second cover portions with surface regions made from an antimicrobial material. The first cover portion has opposing and longitudinally-extending L-shaped lips with at least one pair of first slots defined at opposing locations along the lips. The second cover portion has opposing longitudinal edges for nesting with the first cover portion's lips, and has at least one pair of second slots defined at opposing locations along the edges in alignment with a corresponding pair of the first slots. A joiner is partially engaged in each of the first slots and partially engaged in a correspondingly aligned one of the second slots. Each joiner includes a first spring-loaded portion engaging the first cover portion and a second spring-loaded portion engaging the second cover portion.

25 Claims, 6 Drawing Sheets

(56) References Cited

U.S. PATENT DOCUMENTS

| | | | | | |
|---|---|---|---|---|---|
| 6,065,764 | A * | 5/2000 | Moseley | B62B 5/06 | 150/154 |
| 6,092,442 | A * | 7/2000 | Macor | B25B 13/04 | 81/177.1 |
| 6,543,794 | B1 * | 4/2003 | Tyree | B62B 5/06 | 280/33.992 |
| 6,704,967 | B2 * | 3/2004 | Gianelli | A47K 13/105 | 16/110.1 |
| 6,823,562 | B1 * | 11/2004 | Smith | B25G 1/06 | 16/421 |
| 7,039,996 | B2 * | 5/2006 | Crawley | A45C 13/26 | 16/425 |
| 7,716,789 | B1 * | 5/2010 | Zevallos | E05B 1/0069 | 16/412 |
| 7,980,415 | B2 * | 7/2011 | Crawley | A45F 5/102 | 16/421 |
| 8,276,626 | B2 * | 10/2012 | Balbosa | B62B 5/06 | 150/154 |
| 8,375,521 | B1 * | 2/2013 | Caron | E05B 1/0069 | 16/431 |
| 8,496,074 | B2 * | 7/2013 | Nishikimi | B25F 5/02 | 173/171 |
| 9,162,354 | B1 * | 10/2015 | Wang | B25G 1/10 | |
| 9,615,573 | B1 * | 4/2017 | Moore | A61K 36/185 | |
| 2005/0206104 | A1 * | 9/2005 | Pettigrew | B62B 5/06 | 280/33.992 |
| 2007/0018471 | A1 * | 1/2007 | Pandura | B60N 3/026 | 296/1.02 |
| 2008/0061574 | A1 * | 3/2008 | Seki | A45F 5/1046 | 294/171 |
| 2012/0240307 | A1 * | 9/2012 | Terrell | A41D 19/0086 | 2/158 |

* cited by examiner

ANTIMICROBIAL COVERS FOR RAILS

Pursuant to 35 U.S.C. § 119, the benefit of priority from provisional application 62/231,849, with a filing date of Jul. 17, 2015, is claimed for this non-provisional application.

FIELD OF THE INVENTION

The invention relates generally to rail coverings, and more particularly to covers for rails and adjoining touch surfaces where the covers'surfaces are antimicrobial.

BACKGROUND OF THE INVENTION

Microbes, to include bacteria, fungi, viruses and spores, are readily deposited on hard surfaces. The presence of small amounts of moisture on such surfaces promotes microbe growth. Human or any host contact with such surfaces provides a transmission vehicle for the microbes leading to further deposition, growth, transmission, and, in many cases, human infection.

Microbe growth and transmission is of great concern in hospital settings as well as public areas that present frequently-accessed contact surfaces. In hospitals, a patient's bed presents a number of hard contact surfaces (e.g., bed rails, headboard, footboard, etc.) that caregivers, visitors, and a patient will touch frequently throughout a hospital stay. Since patients are often in a weakened immune state, they are prime candidates for microbe infection. In public areas, hand rails present hard contact surfaces that are prime candidates for microbe deposition, growth, and transmission.

Actively disinfecting contact surfaces is a time-consuming process that is often neglected due to cost, forgetfulness, or lack of concern. Replacement of structures such as hospital beds with completely new structures embodying microbe-susceptible contact surfaces with antimicrobial materials (e.g., the antimicrobial solid surface material disclosed in PCT Application No. PCT/US2013/054040) is a costly proposition beyond the budget constraints of many businesses, institutions and/or cities/municipalities.

SUMMARY OF THE INVENTION

Accordingly, it is an object of the present invention to provide antimicrobial covers for contact surfaces.

Another object of the present invention is to provide antimicrobial covers for rail-like structures.

Still another object of the present invention is to provide antimicrobial covers for rail-like structures that can be installed quickly and without personnel training.

Other objects and advantages of the present invention will become more obvious hereinafter in the specification and drawings.

In accordance with the present invention, a rail cover assembly includes a first cover portion having opposing and longitudinally-extending L-shaped lips and having surface regions defined by an antimicrobial material. At least one pair of first slots is defined at opposing locations along the lips. The assembly also includes a second cover portion having opposing longitudinal edges for nesting with the first cover portion's lips. The second cover portion also has surface regions defined by the antimicrobial material. At least one pair of second slots is defined at opposing locations along the second cover portion's edges and is aligned with a corresponding pair of the first slots. A joiner is partially engaged in each of the first slots and partially engaged in a correspondingly aligned one of the second slots. Each joiner includes a first spring-loaded portion engaging the first cover portion and a second spring-loaded portion engaging the second cover portion.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
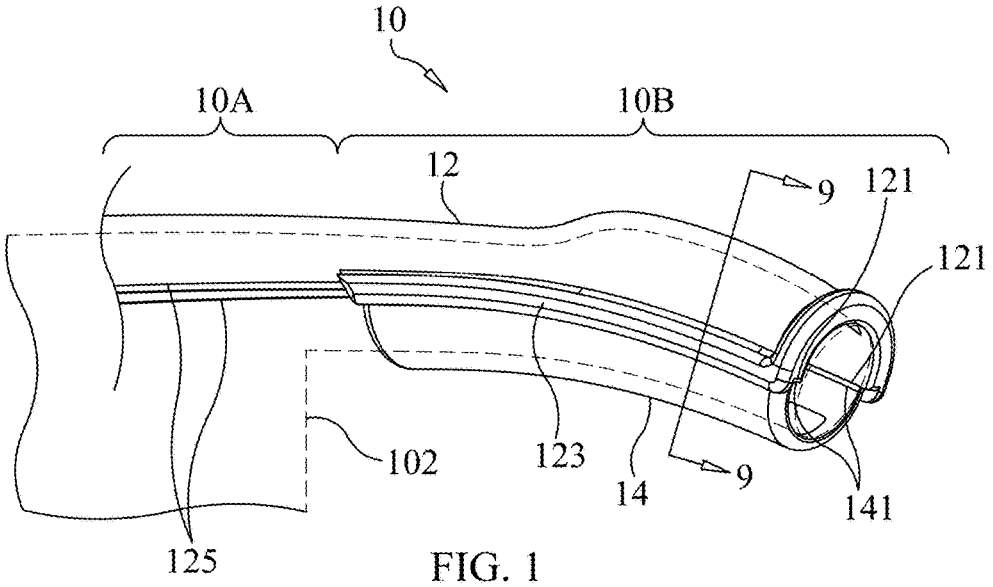
FIG. 1 is a side perspective view of a portion of a rail cover assembly in accordance with an embodiment of the present invention.

Referring now to the drawings and more particularly to FIG. 1, a portion of a rail cover assembly in accordance with an embodiment of the present invention is shown and is referenced generally by numeral 10. In the illustrated embodiment, rail cover assembly 10 includes a portion 10A that can completely encase a rail (e.g., a tubular type of rail 100 illustrated in phantom lines) and an adjacent portion 10B that covers the top of a wall 102 (also illustrated in phantom lines) from which rail 100 extends. For example, wall 102 can be a portion of a headboard or footboard of a hospital bed that includes rail 100. As is known in the art, a conventional hospital bed footboard incorporates a rail 100 at the sides thereof to aid a patient in getting around in his hospital room. These same rails are used by caregivers (or even visitors) when moving the bed. Accordingly, rail 100 and the top of wall 102 present hard surfaces that are prime candidates for microbe deposition, growth, and transmission. For applications where only a rail is to be covered, portion 10B can be omitted. Rail cover assemblies of the present invention can be used to provide biocidal treatment in a wide variety of applications such as, but not limited to, hospital bed headboards, footboards, and side rails; staircase railings; hallway railings in medical facilities and/or public buildings; rails found in public forms of transportation to include buses, trains, and airplanes; etc.

In accordance with the present invention, rail cover assembly 10 includes a top-of-rail cover 12 and a bottom-of-rail cover 14 that can be entirely made from antimicrobial or biocidal material or can be constructed such that at least exposed surfaces of the covers are made from antimicrobial or biocidal materials. By way of example, the exposed surfaces of the top-of-rail and bottom-of-rail covers of cover assembly 10 can be a composite solid material made from a polymeric resin with copper oxide particles mixed therein disclosed in PCT Application No. PCT/US2013/054040, the entire contents of which are hereby incorporated by reference. It is to be understood that other antimicrobial or biocidal materials could be used without departing from the scope of the present invention. When the entirety of the top-of-rail and bottom-of-rail covers is made using such antimicrobial materials, the covers could be cast, molded, or fabricated in a variety of ways without departing from the scope of the present invention.

As will be explained further below, top-of-rail cover 12 is mechanically coupled to bottom-of-rail cover 14 using rigid (e.g., metal) cover-joining clips 16 (FIGS. 6-9) in a way that supports rail cover assembly 10 being quickly and securely assembled/coupled to rail 100 and top of wall 102 without any training of personnel performing such an installation. Once rail cover assembly 10 is in place, the most readily-touched surfaces of rail 100 and wall 102 are covered/protected by antimicrobial materials to thereby substantially reduce microbe growth and transmission at the surfaces of rail cover assembly 10.

Figure 2:
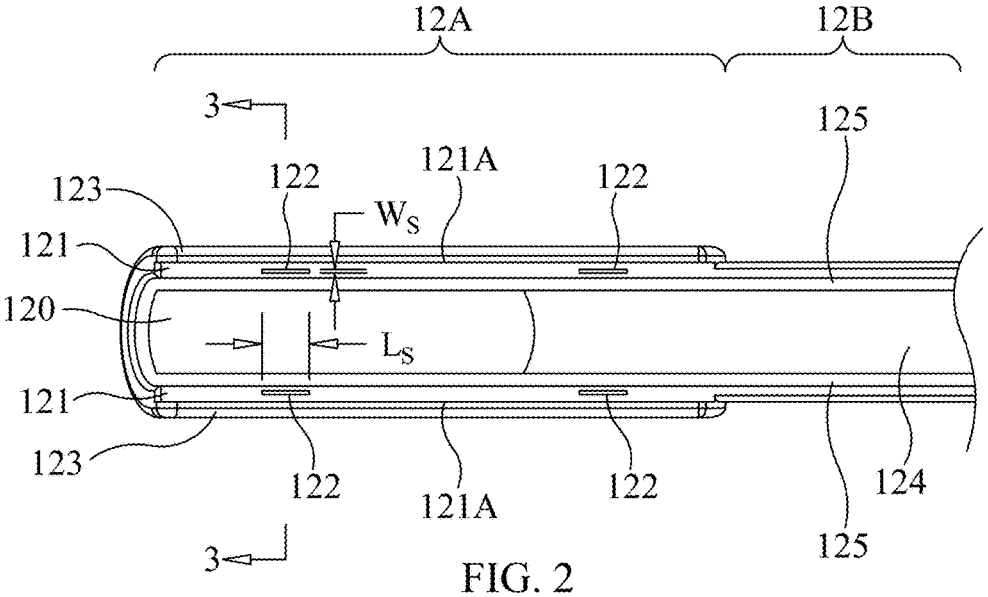
FIG. 2 is an isolated plan view of a portion of the top-of-rail cover as viewed from the underside thereof.
Figure 3:
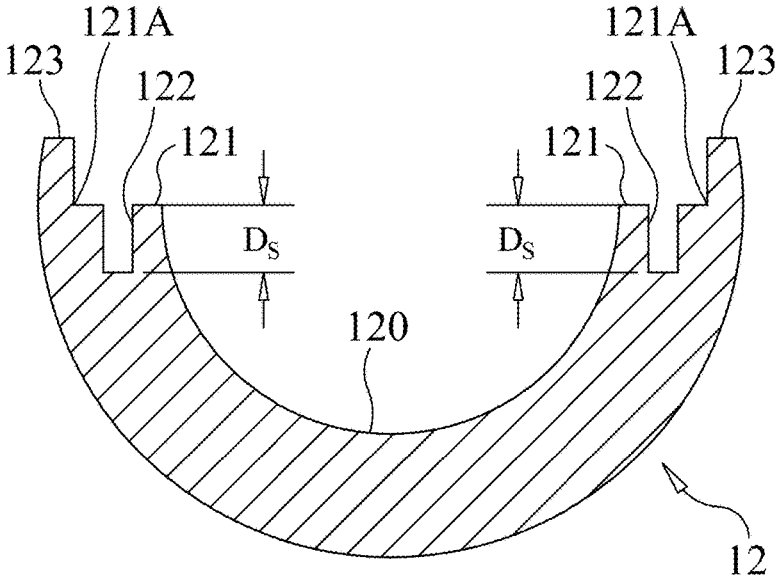
FIG. 3 is a cross-sectional view of the top-of-rail cover taken along line 3-3 in FIG. 2.

Referring additionally now to FIGS. 2 and 3, top-of-rail cover 12 is shown in isolation with a plan view from the underside thereof shown in FIG. 2 and a cross-sectional view thereof shown in FIG. 3. Top-of-rail cover 12 includes a portion 12A that forms part of the complete encasement portion 10A of rail cover assembly 10, and a portion 12B that forms the portion 10B of assembly 10 that covers the top of wall 102 as described above. Along the length of portion 12A, an inner surface 120 is shaped to engage the top portion (e.g., the top half) of a rail. For example, if the rail to be covered is cylindrical as shown in FIG. 1, inside surface 120 is semi-cylindrical to rest on the top half of the rail. Inside surface 120 can also be contoured along portion 12A to accommodate contours in the portion of a rail it is to cover such that the top portion of a rail to be covered nests with inside surface 120. A bottom edge 121 is defined along each edge of inside surface 120. Each bottom edge 121 has one or more slots 122 defined therein. Each slot 122 will receive a portion of a cover-joining clip 16 shown in FIGS. 6-9 and as will be described further below. Each slot 122 has length "$L_S$" along edge 121, a width "$W_S$", and a depth "$D_S$". A flange 123 extends perpendicularly from the outside edge 121 A of each bottom edge 121 such that the combination of bottom edge 121 and its corresponding flange 123 define an L-shaped lip all along each side of portion 12A. All along the length of portion 12B, an inside surface 124 is shaped to engage or rest on the top portion of a non-rail structure (e.g., wall 102 as described above) that is adjacent to a rail being covered by portion 12A. Similar to inside surface 120, inside surface 124 can be contoured along portion 12B to accommodate contours of the top of a structure (e.g., top of wall 102) it is to cover. Opposing longitudinal edges 125 of portion 12B can be aligned with edges 121 of portion 12A.

Figure 4:
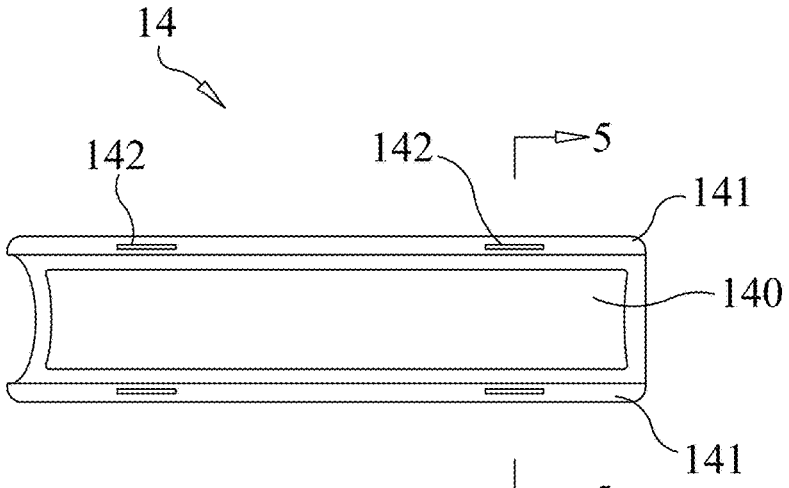
FIG. 4 is an isolated plan view of a portion of a bottom-of-rail cover as viewed from the top side thereof.
Figure 5:
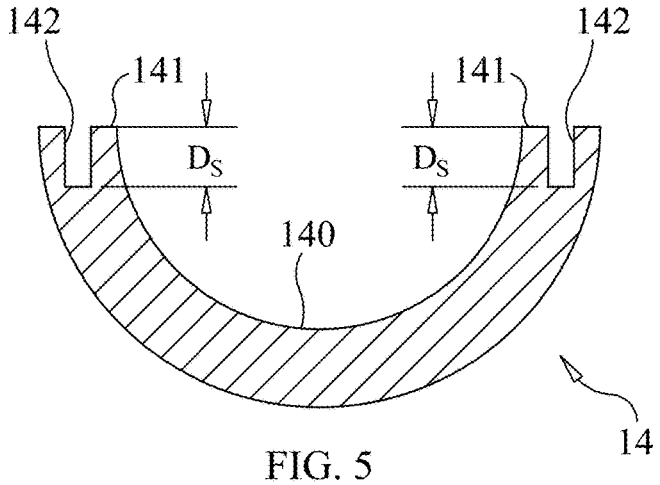
FIG. 5 is a cross-sectional view of the bottom-of-rail cover taken along line 5-5 in FIG. 4.
Figure 8:
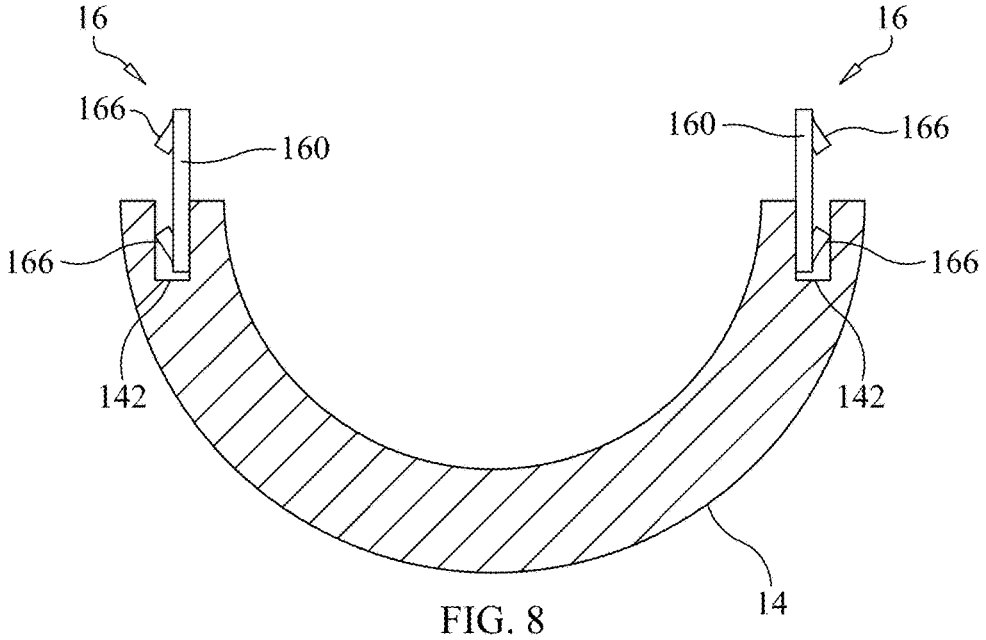
FIG. 8 is a cross-sectional view of the bottom-of-rail cover with cover-joining clips in the slots thereof.
Figure 9:
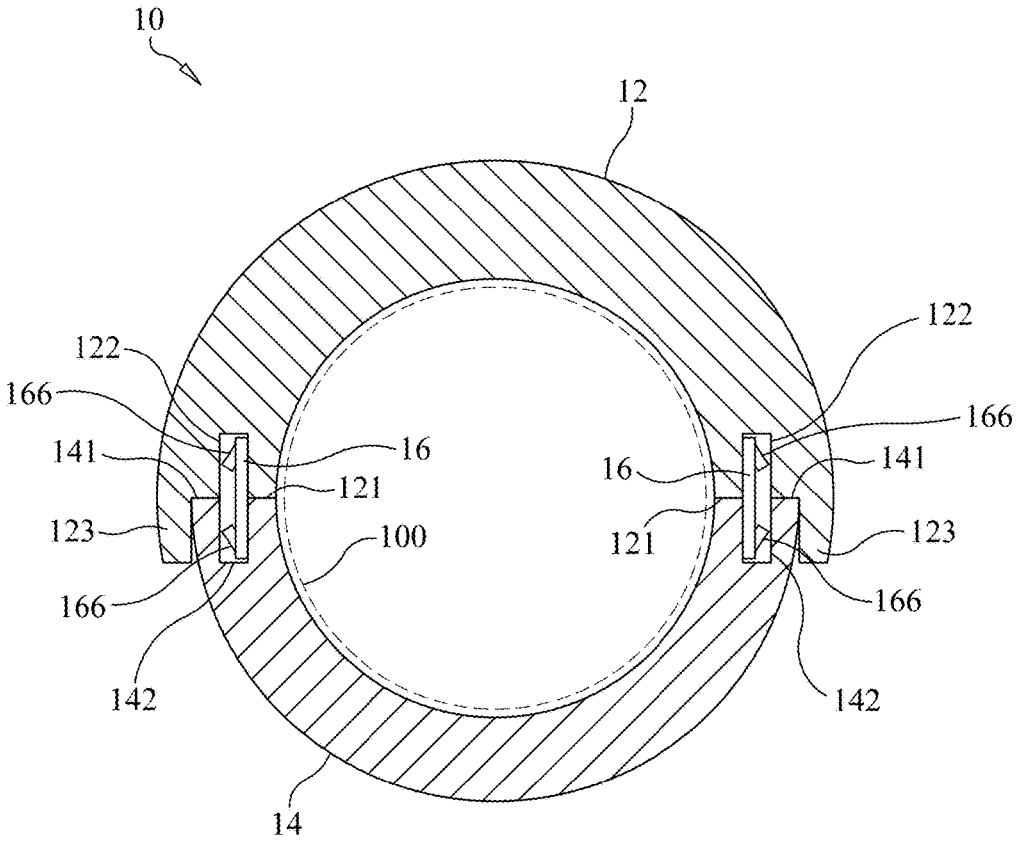
FIG. 9 is a cross-sectional view of a rail cover assembly to include its cover-joining clips taken along line 9-9 in FIG. 1.

Referring additionally now to FIGS. 4 and 5, bottom-of-rail cover 14 is shown in isolation with a plan view from the top side thereof shown in FIG. 4 and a cross-sectional view thereof shown in FIG. 5. Along its length, bottom-of-rail cover 14 has an inside surface 140 shaped to engage the bottom portion (e.g., the bottom half) of a rail. For example, if the rail to be covered is cylindrical, inside surface 140 is semi-cylindrical to rest against the bottom of the rail. Inside surface 140 can also be contoured to accommodate contours in the portion of a rail it is to cover such that the bottom portion of a rail to be covered nests with inside surface 140. An edge 141 is defined along each opposing longitudinal edge of inside surface 140 and is sized to nest with the opposing L-shaped lips defined by cover 12's bottom edge 121 and flange 123. When top-of-rail cover 12 and bottom-of-rail cover 14 are assembled to define cover assembly 10 as shown in FIG. 9, each bottom edge 141 has one or more slots 142 defined therein and located to be in correspondence with slots 122 of top-of-rail cover 12 such that slots 122 and 142 align with one another as shown in FIGS. 1 and 9. While the number of slots used in covers 12 and 14 is not a limitation of the present invention, there will generally always be at least one pair of slots on opposing sides of a top-of-rail cover 12 and an aligned pair of slots on opposing sides of a corresponding bottom-of-rail cover 14. Each slot 142 will receive a portion of a cover-joining clip 16 (FIGS. 6-9) as will be described further below. Each slot 142 has a length "$L_S$" along edge 141, a width "$W_S$", and a depth "$D_S$", where such dimensions can be matched to the corresponding dimensions of slots 122.

Figure 6:
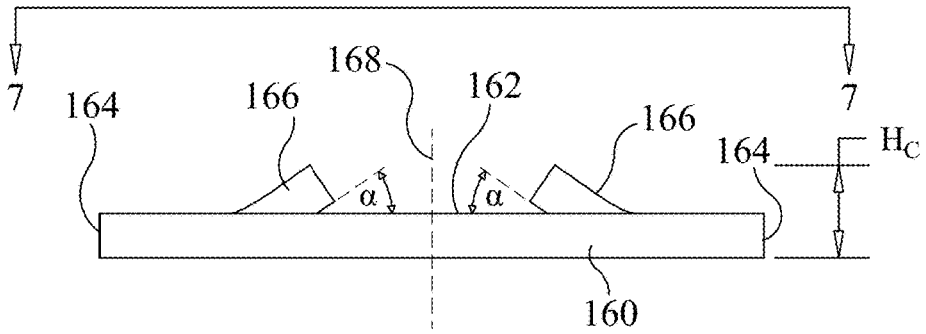
FIG. 6 is a side view of a cover-joining clip in its pre-installation configuration in accordance with an embodiment of the present invention.
Figure 7:
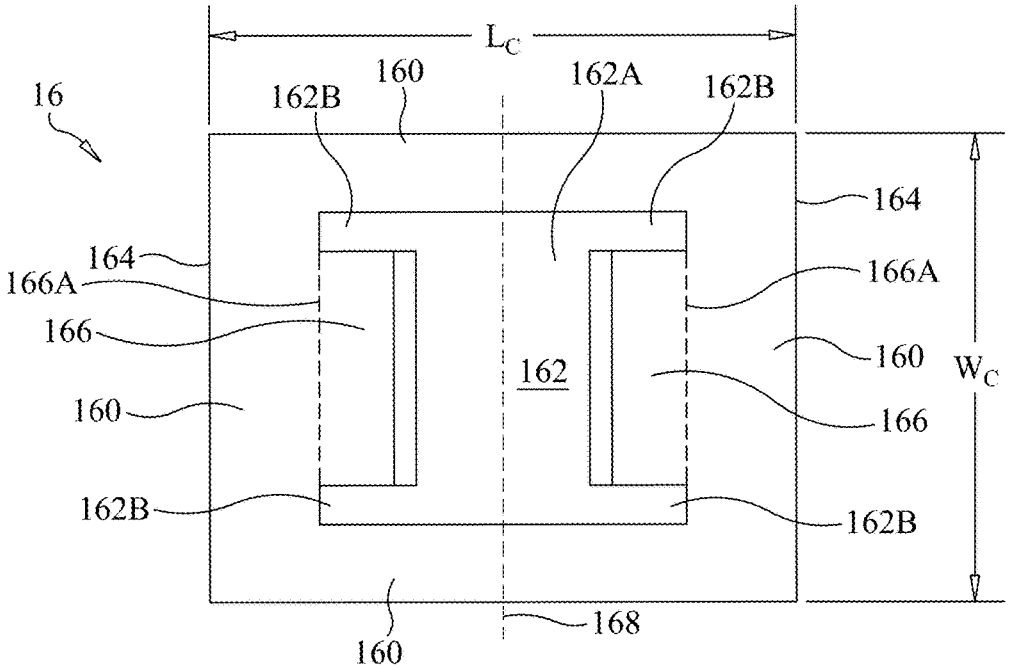
FIG. 7 is a plan view of the cover-joining clip taken along line 7-7 in FIG. 6.

Referring now to FIGS. 6 and 7, a cover-joining clip 16 is shown in its pre-installation configuration in side and plan views, respectively. Clip 16 is made from a rigid sheet of material (e.g., metal). In the illustrated embodiment, clip 16 has a generally rectangular outer shape whose width "$W_C$" is less than the length $L_S$ of slots 122 and slots 142. The length "$L_C$" of clip 16 is longer than the depth $D_S$ of slots 122 and longer than the depth $D_S$ of slots 142. By way of example, if the depth $D_S$ of slots 122 is approximately equal to the depth $D_S$ of slots 142, the length $L_C$ of clip 16 can be up to twice that of the depth $D_S$ of slots 122 and 142 in order to allow edge 121 rest against edge 141 when cover assembly 10 is completed as shown in FIGS. 1 and 9. Prior to inclusion of clip 16 in cover assembly 10, the height "$H_C$" of each clip 16 is greater than the width $W_S$ of slots 122 and 142 as shown in F"IG. 6.

In the illustrated example, clip 16 is a monolithic structure having an outer, continuous frame 160 and an inner open region 162 with frame 160 lying in a plane. For example, clip 16 can be stamped from a sheet of metal. Frame 160 circumscribes an "I-shaped" inner open region 162 of clip 16. That is, frame 160 is defined by the clip's material and open region 162 is defined by air. I-shaped open region 162 includes a central rectangular region 162A and four slots 162B extending away from the four corners of central region 162A. As a result, ramp regions 166 are defined and extend away from frame 160 near opposing longitudinal ends 164 of frame 160 into central region 162A. When clip 16 is stamped from a single sheet of metal, each ramp region 166 is bent along a region referenced by dashed line 166A such that each ramp region is angled at an acute angle $\alpha$ with respect to the plane of frame 160. The angle $\alpha$ is selected such that the pre-installation height $H_C$ of clip 16 is greater than the width $W_S$ of slots 122 and 142. While angle $\alpha$ will typically be approximately the same for each ramp region 166 of a clip 16, each such angle could be different without departing from the scope of the present invention. By virtue of this configuration, each ramp region 166 will have a spring bias away from the plane of frame 160. In the illustrated embodiment, each of ramp regions 166 terminates before the center 168 of clip 16 that divides the clip into two mirror-imaged halves relative to center 168.

To assemble rail cover assembly 10 as shown in FIGS. 1 and 9, a clip 16 is pressed into each slot of one of a top-of-rail cover 12 and bottom-of-rail cover 14. For example, FIG. 8 illustrates a cross-section of bottom-of-rail cover 14 with clips 16 positioned in slots 142 thereof. Each clip's ramp regions 166 can face to the outside of cover 14 (as shown) or to the inside of the cover without departing from the scope of the present invention. Since the length $L_C$ of clip 16 is approximately twice the depth $D_S$ of a slot, approximately half of each clip 16 is in the corresponding slot and half extends from the slot. Since the pre-installation height $H_C$ of clip 16 is greater than the slot's width $W_S$, clip 16 is firmly held in place as ramp region 166 engages the sides of slot 142. For example, when clip 16 is made from a sheet of metal, each ramp region 166 is driven or flexes towards the plane of frame 160 (i.e., against the spring bias of each ramp region) as clip 16 is pressed into slot 142 thereby allowing clip 16 to act as a compressed spring engaging the side walls of slot 142. With clips 16 in place as shown, bottom-of-rail cover 14 can be positioned under a rail to be covered and a corresponding top-of-rail cover 12 can be positioned over the rail and pressed into engagement with the exposed portions/halves of clips 16 extending from bottom-of-rail cover 14. Since the length $L_S$ of the slots in each cover 12 and 14 is greater than the width $W_C$ of clips 16, an alignment tolerance is defined between covers 12 and 14 thereby facilitating an efficient and fast assembly process. The assembly process is completed by simply pressing an aligned top-of-rail cover 12 over its corresponding bottom-of-rail cover 14. As cover 12 is pressed towards cover 14, the portion of each clip 16 extending from cover 14 engages a corresponding slot 122 in the same way clip 16 engaged a slot 142 of cover 14 as described above. Once assembled, flange 123 of top-of-rail cover 12 covers edge 141 of bottom-of-rail cover 14 to thereby define a tubular assembly that completely encase a rail 100 as illustrated in FIGS. 1 and 9.

As mentioned above, when covers 12 and 14 have their exposed surfaces or their entire structure made from an antimicrobial material, the resulting rail cover assembly defines a hard surface that continually provides biocidal treatment of microbes deposited thereon without any periodic disinfection operation being required. To further enhance the material surface's biocidal activity, the covers of the present invention can have their outer surfaces constructed to provide increased surface area. The increased surface area enhances the biocidal activity at the cover's outer surfaces. Since microbes are microscopic particles, surface treatment of the covers' outer surfaces can occur at either microscopic or macroscopic levels. For example, it may be desired for the outer surfaces of the covers to present a macroscopically smooth surface for purpose of aesthetics, ease of cleaning, etc. In this case, biocidal enhancement could be provided via a microscopic texturing (e.g., piercing, roughening, etc.) of the covers' outer surfaces. Such microscopic texturing can be incorporated into a molding or casting process.

Figure 10:
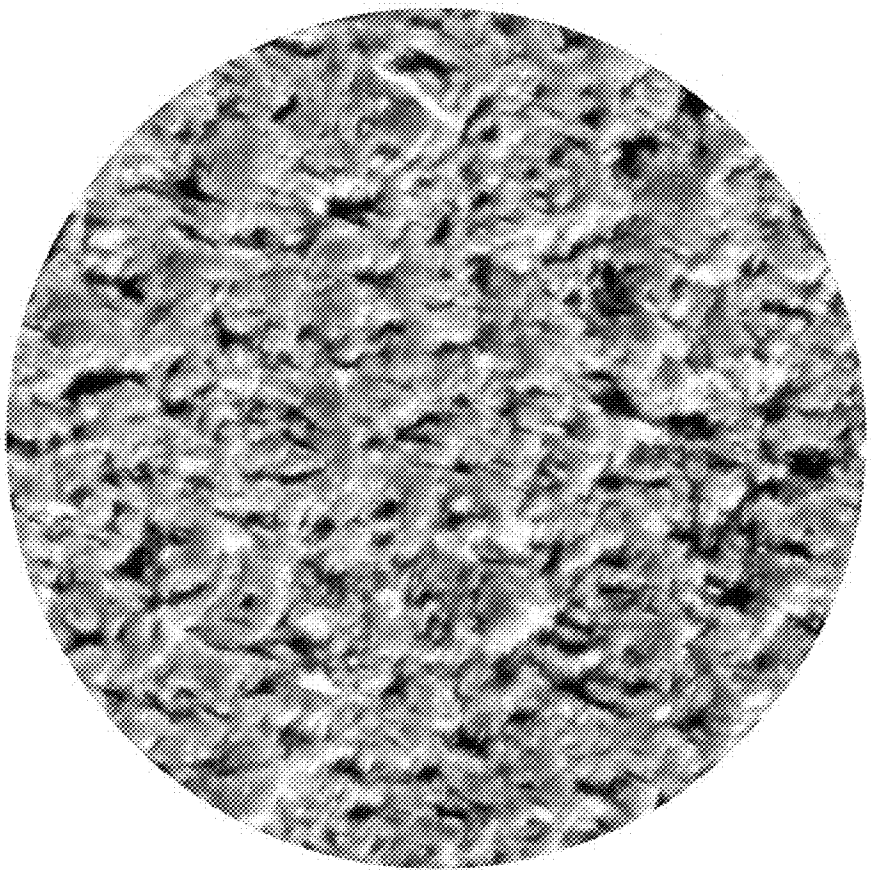
FIG. 10 is a magnified microscopic image of the surface of an antimicrobial material that has undergone surface texturing in accordance with an embodiment of the present invention.

By way of example, FIG. 10 illustrates a microscopically-textured surface of the above-referenced polymeric resin with copper oxide particles mixed therein. In this example, the depth of the valleys (indicated by the darkest regions in the image) formed during texturing range up to approximately 60 micrometers. In tests comparing these textured cover samples against non-textured cover samples made from the same material, it was found that the textured cover samples performed substantially better in terms of biocidal activity. Specifically, when both types of textured-surface and non-textured-surface samples had the Enterobacter Aerogenes (ACT 13048) bacteria deposited on the samples' surfaces, the textured cover samples achieved a 99.98% reduction in the Enterobacter Aerogenes (ACT 13048) bacteria after only 45 minutes of contact time. The non-textured-surface samples did not achieve such substantial reductions in bacteria in the same 45 minute test time.

The advantages of the present invention are numerous. The antimicrobial covers provide a simple and long-term solution for microbe protection of rails and adjoining contact surfaces that are breeding grounds for microbe growth. No messy glues or noxious-smelling adhesives are required to assemble the covers. The cover assemblies can be installed on rails "in situ" and in minutes by maintenance personnel with little or no training. The antimicrobial material provides long-term biocidal activity that can be enhanced by microscopic texturing having no impact on the macroscopic feel or appearance of the covers.

Although the invention has been described relative to specific embodiments thereof, there are numerous variations and modifications that will be readily apparent to those skilled in the art in light of the above teachings. For example, adhesive/glue and/or small pieces of adhesive strips/tape could be provided on inside surface regions of the covers to hold the covers in place during the assembly process and/or make their installation more permanent. Further, shapes of the covers' slots and/or the clips used to join the covers could be modified without departing from the scope of the present invention. Still further, the covers of the present invention could include other decorative and/or functional materials to satisfy an application's requirements. It is therefore to be understood that, within the scope of the appended claims, the invention may be practiced other than as specifically described.

What is claimed as new and desired to be secured by Letters Patent of the United States is:

1. A rail cover assembly, comprising:

a first cover portion having opposing and longitudinally-extending L-shaped lips, said first cover portion having surface regions defined by an antimicrobial material;

at least one pair of first slots defined at opposing locations along said lips;

a second cover portion having opposing longitudinal edges for nesting with said lips, said second cover portion having surface regions defined by said antimicrobial material;

at least one pair of second slots defined at opposing locations along said edges and aligned with a corresponding pair of said first slots; and a joiner for partial engagement in each of said first slots and for partial engagement in a correspondingly aligned one of said second slots, said joiner including a first spring-loaded portion engaging said first cover portion and a second spring-loaded portion engaging said second cover portion.

2. A rail cover assembly as in claim 1, wherein each of said first slots and each of said second slots has a length, wherein each said joiner has a width, wherein said width of said joiner is aligned along said length of said first slots and said second slots, and wherein said length is greater than said width.

3. A rail cover assembly as in claim 1, wherein said joiner comprises a monolithic metal structure.

4. A rail cover assembly as in claim 1, wherein said joiner comprises:

a metal frame lying in a plane, said metal frame circumscribing an open region in a central portion of said metal frame;

a first metal ramp coupled to said metal frame and extending into said open region, said first metal ramp at a first acute angle with respect to said plane; and a second metal ramp coupled to said metal frame and extending into said open region, said second metal ramp at a second acute angle with respect to said plane.

5. A rail cover assembly as in claim 4, wherein said first acute angle is approximately equal to said second acute angle.

6. A rail cover assembly as in claim 1, wherein said joiner comprises:

a metal frame lying in a plane, said metal frame circumscribing an open region in a central portion of said metal frame;

a first metal ramp coupled to said metal frame at a first end thereof and extending into said open region, said first metal ramp at a first acute angle with respect to said plane; and a second metal ramp coupled to said metal frame at a second end thereof opposing said first end, said second metal ramp extending into said open region, said second metal ramp at a second acute angle with respect to said plane.

7. A rail cover assembly as in claim 6, wherein said first acute angle is approximately equal to said second acute angle.

8. A rail cover assembly as in claim 6, wherein said metal frame, said first metal ramp, and said second metal ramp comprise a monolithic structure.

9. A rail cover assembly as in claim 1, further comprising an extension cover coupled to said first cover portion, said extension cover having opposing longitudinal edges aligned with said lips.

10. A rail cover assembly as in claim 1, wherein said surface regions of said first cover portion and said surface regions of said second cover portion comprise microscopically textured surfaces.

11. A rail cover assembly, comprising:

a semi-cylindrical first cover having opposing and longitudinally-extending L-shaped lips, said first cover having surface regions defined by an antimicrobial material;

at least one pair of first slots defined at opposing locations along said lips;

a semi-cylindrical second cover having opposing longitudinal edges nested with said lips wherein a tubular region is defined by said first cover and said second cover, said second cover having surface regions defined by said antimicrobial material;

at least one pair of second slots defined at opposing locations along said edges and aligned with a corresponding pair of said first slots; and a joiner partially engaged in each of said first slots and partially engaged in a correspondingly aligned one of said second slots, said joiner including a first spring-loaded portion engaging said first cover portion and a second spring-loaded portion engaging said second cover portion.

12. A rail cover assembly as in claim 11, wherein each of said first slots and each of said second slots has a length, wherein each said joiner has a width, wherein said width of said joiner is aligned along said length of said first slots and said second slots, and wherein said length is greater than said width.

13. A rail cover assembly as in claim 11, wherein said joiner comprises a monolithic metal structure.

14. A rail cover assembly as in claim 11, wherein said joiner comprises:

a metal frame lying in a plane, said metal frame circumscribing an open region in a central portion of said metal frame;

a first metal ramp coupled to said metal frame and extending into said open region, said first metal ramp at a first acute angle with respect to said plane; and a second metal ramp coupled to said metal frame and extending into said open region, said second metal ramp at a second acute angle with respect to said plane.

15. A rail cover assembly as in claim 14, wherein said first acute angle is approximately equal to said second acute angle.

16. A rail cover assembly as in claim 11, wherein said joiner comprises:

a metal frame lying in a plane, said metal frame circumscribing an open region in a central portion of said metal frame;

a first metal ramp coupled to said metal frame at a first end thereof and extending into said open region, said first metal ramp at a first acute angle with respect to said plane; and a second metal ramp coupled to said metal frame at a second end thereof opposing said first end, said second metal ramp extending into said open region, said second metal ramp at a second acute angle with respect to said plane.

17. A rail cover assembly as in claim 16, wherein said first acute angle is approximately equal to said second acute angle.

18. A rail cover assembly as in claim 16, wherein said metal frame, said first metal ramp, and said second metal ramp comprise a monolithic structure.

19. A rail cover assembly as in claim 11, further comprising a semi-cylindrical extension cover coupled to said first cover, said extension cover having opposing longitudinal edges aligned with said lips.

20. A rail cover assembly as in claim 11, wherein said surface regions of said first cover and said surface regions of said second cover comprise microscopically textured surfaces.

21. A rail cover assembly, comprising:

a semi-cylindrical first cover having opposing and longitudinally-extending L-shaped lips, said first cover having surface regions defined by an antimicrobial material;

at least one pair of first slots defined at opposing locations along said lips;

a semi-cylindrical second cover having opposing longitudinal edges nested with said lips wherein said first cover and said second cover define a tube, said second cover having surface regions defined by said antimicrobial material;

at least one pair of second slots defined at opposing locations along said edges and aligned with a corresponding pair of said first slots; and a monolithic metal joiner partially engaged in each of said first slots and partially engaged in a correspondingly aligned one of said second slots, said joiner including a metal frame lying in a plane and circumscribing an open region in a central portion of said metal frame, a first metal ramp coupled to said metal frame and extending into said open region at a first acute angle with respect to said plane, and a second metal ramp coupled to said metal frame and extending into said open region at a second acute angle with respect to said plane, said first metal ramp engaging said first cover and said second metal ramp engaging said second cover.

22. A rail cover assembly as in claim 21, wherein each of said first slots and each of said second slots has a length, wherein each said joiner has a width, wherein said width of said joiner is aligned along said length of said first slots and said second slots, and wherein said length is greater than said width.

23. A rail cover assembly as in claim 21, wherein said first acute angle is approximately equal to said second acute angle.

24. A rail cover assembly as in claim 21, further comprising a semi-cylindrical extension cover coupled to said first cover, said extension cover having opposing longitudinal edges aligned with said lips.

25. A rail cover assembly as in claim 21, wherein said surface regions of said first cover and said surface regions of said second cover comprise microscopically textured surfaces.

* * * * *